US007137797B2

(12) United States Patent
Krayer

(10) Patent No.: US 7,137,797 B2
(45) Date of Patent: Nov. 21, 2006

(54) TURNTABLE WITH GEROTOR

(76) Inventor: William L. Krayer, 1771 Helen Dr., Pittsburgh, PA (US) 15216

( * ) Notice: Subject to any disclaimer, the term of this patent is extended or adjusted under 35 U.S.C. 154(b) by 305 days.

(21) Appl. No.: 10/791,596

(22) Filed: Mar. 2, 2004

(65) Prior Publication Data

US 2005/0196310 A1 Sep. 8, 2005

(51) Int. Cl.
*F01C 21/10* (2006.01)
*F03C 2/00* (2006.01)

(52) U.S. Cl. ..... 418/150; 108/139; 108/130; 108/94; 312/238; 418/61.3; 418/166

(58) Field of Classification Search ..... 108/20–22, 108/94, 103, 139; 312/238; 418/166, 61.3, 418/150
See application file for complete search history.

(56) References Cited

U.S. PATENT DOCUMENTS 1,628,013 A 5/1927 Twedt
2,062,807 A 12/1936 Cramer
2,209,201 A 7/1940 Hill
2,648,579 A 8/1953 Slyter et al.
2,874,594 A 2/1959 Sundt
2,988,065 A 6/1961 Wankel et al.
2,994,277 A * 8/1961 Merritt ..... 418/150
3,304,808 A 2/1967 Grant
3,369,320 A 2/1968 Hronas et al.
3,779,521 A 12/1973 Godines
3,834,842 A 9/1974 Dorff et al.
3,913,533 A 10/1975 Meaden
3,937,458 A 2/1976 Langen
3,955,903 A * 5/1976 de Dobo ..... 418/150
4,018,548 A 4/1977 Berkowitz
4,035,706 A 7/1977 Cutler
4,052,928 A 10/1977 Pierrat et al.
4,074,778 A 2/1978 Morrell et al.
4,084,927 A 4/1978 Amdall
4,086,038 A 4/1978 Lambrecht
4,389,172 A 6/1983 Griffith
4,519,755 A 5/1985 Hanson
4,587,908 A 5/1986 DeBruyn
5,046,932 A 9/1991 Hoffmann
5,152,592 A 10/1992 Krayer
5,701,694 A 12/1997 Atkinson (Continued)

FOREIGN PATENT DOCUMENTS

JP 11267950 A * 10/1999

OTHER PUBLICATIONS

Martin Gardner, "Mathematical Games," Scientific American, p. 148-156, (Feb. 8, 1963).

(Continued)

*Primary Examiner*—Theresa Trieu

(57) ABSTRACT

A gerotor mechanism is used to guide the rotation of a turntable having a Reuleaux triangle shape. The mechanism includes a gerotor having three lobes; the gerotor guide has a guide profile including four recesses for receiving the lobes of the gerotor. Rotation is governed by a 4:3 hypocycloid function. The profiles of the gerotor and the gerotor guide are expanded uniformly from an original hypocycloid pattern so that rotation of the turntable results in execution of the hypocycloid function while retaining the gerotor in controlled contact with the profile of the gerotor guide. Substantially planar bearing surfaces may be used at the interface of (a) the turntable and the gerotor guide, (b) the gerotor and the gerotor guide, or (c) the gerotor and the underlying support surface. The gerotor guide may be part of a cabinet or built into a kitchen countertop.

17 Claims, 8 Drawing Sheets

U.S. PATENT DOCUMENTS

| | | | |
|---|---|---|---|
| 5,762,484 | A | 6/1998 | Whitham |
| 5,820,504 | A | 10/1998 | Geralde |
| 6,213,744 | B1 | 4/2001 | Choroszylow et al. |
| 6,322,679 | B1 | 11/2001 | De Bosscher et al. |
| 6,552,349 | B1 | 4/2003 | Gagnon et al. |
| 6,568,772 | B1 | 5/2003 | Gerkey et al. |

OTHER PUBLICATIONS

Franz Reuleaux, "The Kinematics of Machinery," Dover Publications, Inc. (New York, NY), p. 131-168, (Apr. 8, 1963).

* cited by examiner

TURNTABLE WITH GEROTOR

TECHNICAL FIELD

This invention relates to turntables, rotatable shelves, and lazy susans, particularly for corner cabinets and the back corners of kitchen countertops. The invention is an eccentric rotation and bearing system for a Reuleaux triangle shaped turntable.

BACKGROUND OF THE INVENTION

This invention is an improvement on Krayer U.S. Pat. No. 5,152,592, which discloses the use of a 4:3 hypocycloid rotation guide for rotating a shelf in the shape of a Reuleaux triangle. FIGS. 5A to 5H of the '592 patent illustrate that the rotation of a Reuleaux triangle-shaped shelf in a square area can be adapted to the floor or shelf of a corner cabinet such as a standard corner kitchen cabinet in a generally square shape. During the rotation, the shelf contacts all four sides of the square area at all times, the apexes of the Reuleaux triangle describing the substantially square area as they rotate, and results in alternate recessed and projecting modes when used in a corner cabinet having a 45° face. The kinematics of such a rotation permits various types of guides such as are shown in FIGS. 6–13 and 17–19 of the U.S. Pat. No. 5,152,592 patent. The entire patent U.S. Pat. No. 5,152,592 is incorporated herein by reference.

While the shelf disclosed by Krayer in U.S. Pat. No. 5,152,592 is appealing in many respects, the guide system in practice entailed the use of ball casters in a groove such as depicted in FIG. 7. The ball casters were noisy and their durability was suspect.

This invention is also an improvement on Gerkey and Kugler U.S. Pat. No. 6,568,772, which describes the use of substantially planar bearings for a shelf or turntable in the shape of a Reuleaux triangle. This patent is also incorporated herein by reference in its entirety.

While the planar bearings of the Gerkey and Kugler disclosure are an excellent improvement on the ball casters disclosed in Krayer U.S. Pat. No. 5,152,592, the guide groove and vertical-axis rollers proposed by Gerkey and Kugler to guide the rotation of the shelf save little in terms of expense compared to my earlier proposed ball casters and groove. Accordingly, a different application of the hypocycloid principle is needed in the art of rotatable shelves.

The reader may be interested in reviewing some or all of the patents mentioned in this paragraph. The term "gerotor," used in the present disclosure and claims, may be found, for example, in Hanson U.S. Pat. No. 4,519,755 and Whitham U.S. Pat. No. 5,762,484. Illustrations of various internal gear-like mechanisms having ratios other than 4:3 may be seen in the following U.S. patents: Grant U.S. Pat. No. 3,304,808, Sundy U.S. Pat. No. 2,874,594, Hill U.S. Pat. No. 2,209,201, Dorff et al U.S. Pat. No. 3,834,842, Godines U.S. Pat. No. 3,779,521, Meaden U.S. Pat. No. 3,913,533, Geralde U.S. Pat. No. 5,820,504, and Hoffmann U.S. Pat. No. 5,046,932. The term "Reuleaux triangle" appears recently in Gagnon et U.S. Pat. No. 6,552,349; see also Morrell et al U.S. Pat. No. 4,074,778, and Roepke et al U.S. Pat. Nos. 4,012,077 and 4,062,595. Many turning supports such as swivels for various turntable-like elements have been suggested—see, for example, U.S. Pat. No. 2,062,807 to Cramer, U.S. Pat. No. 2,648,579 to Slyter et al, U.S. Pat. No. 5,701,694 to Atkinson, and U.S. Pat. No. 1,628,013 to Twedt.

SUMMARY OF THE INVENTION

In one aspect, my invention comprises a guide mechanism for turning a Reuleaux triangle shaped object within a substantially square area comprising a base and a gerotor attached to the Reuleaux triangle shaped object, the base housing an interior rotation profile comprising quadrilaterally symmetrical recesses and the gerotor having an exterior rotation profile comprising trilaterally symmetrical lobes, the shapes and sizes of the base and the gerotor being derived from a hypocycloid function having a ratio of 4:3 and resulting in the containment of the rotor within the interior rotation profile of the base so that no substantial movement of the gerotor within the base will occur other than one derived from the hypocycloid function. Where the turntable is substantially horizontal, its weight or load is supported on substantially planar bearing surfaces which may be interfacing surfaces of (a) the underside of the Reuleaux triangle shaped object and the upper side of the base, or (b) the underside of the gerotor and a surface on the base and within the interior rotation profile, or (c) the underside of the gerotor and a surface on which the turntable is placed, such as a countertop, or a cabinet floor or shelf. A common use of the invention is expected to be as a turntable, turned by the user, located in a corner cabinet or in a back countertop corner, so that the Reuleaux triangle shaped turntable will make efficient use of the corner space while providing convenient access to items on the turntable. The turntable itself may support a cabinet or a more intricate storage unit, or any structure wherein the unique turning characteristics of the invention are useful.

The present invention utilizes a turning guide for a Reuleaux triangle turntable requiring neither ball casters as suggested in my earlier patent nor vertical-axis rollers as proposed by Gerkey and Kugler. Rather, the present invention may utilize substantially planar bearings comprising a base bearing and a turntable bearing, the base bearing having an interior rotation profile comprising quadrilaterally symmetrical recesses and the turntable bearing having an exterior rotation profile comprising trilaterally symmetrical lobes, the shapes and sizes of the base bearing and the turntable bearing being derived from a hypocycloid function having a ratio of 4:3 and resulting in the containment of the turntable bearing within the base bearing so that no substantial movement of the turntable bearing within the base bearing will occur other than one kinematically dictated by the hypocycloid function. The center of the turntable bearing, which I call a gerotor, is attached to the center of the turntable (sometimes referred to as a shelf).

In another aspect, my invention comprises a gerotor bearing, a Reuleaux triangle shaped turntable attached to the gerotor bearing, and a gerotor guide bearing, the gerotor guide bearing and gerotor bearing being in a hypocycloid relationship, the hypocycloid relationship being based on a gerotor guide circle having a diameter about 0.6184 times the width of the Reuleaux triangle shaped turntable or its functional equivalent, the gerotor guide circle further being in a ratio of 4:3 to a gerotor circle, whereby the shapes of the gerotor and the gerotor guide are determined by the path of a point on the gerotor circle turning in hypocycloid relation within the gerotor guide circle, and wherein the shapes of the gerotor and the gerotor guide are expanded from the path by a dimension g. The parametric equations $x=0.25R \cos\theta+0.75R \cos\theta/3$ and $y=0.25R \sin\theta-0.75R \sin\theta/3$ will yield the internal profile of the gerotor guide prior to expansion, where R is the radius of the large circle and θ is the angle of the center of the gerotor circle with respect to the center of the gerotor guide circle. By expansion, I mean that the internal profile of the gerotor guide is made larger by a desired dimension g which is applied around the entire perimeter of the profile. More particularly, the shapes of the gerotor guide bearing and gerotor bearing are expanded by an increment between about 1/10 to about one-half of the radius of the gerotor guide circle. The gerotor will turn smoothly in the gerotor guide, resulting in points at the apexes of the Reuleaux triangle describing four straight lines comprising a substantially square area. In practice, one may want to provide a small space between the gerotor and the gerotor guide around their peripheries to assure smooth turning.

In another aspect, my invention utilizes a 4:3 hypocycloid rotation, and in particular the path followed by a point on the smaller circle as it rotates within the larger circle. Such a point will describe a concave square (see dotted lines E in FIG. 1). My invention includes the use of a rotor guide having a profile determined by expanding such a point path preferably by a distance of at least one-half the distance between the centers of the two circles. The expansion may be considerably larger, but I prefer between about 0.75 and 2 times the distance between the centers of the two circles. More preferably, the expansion dimension g will be between about 0.2R and 0.45R. If the expansion is less than about 0.125R, the rotor may be subject to jamming in the rotor guide but nevertheless may be useful in some circumstances; if it is larger than 0.5R, the rotor guide may be too large for some applications.

The term "gerotor" may appear in the prior art to describe either a gear-type member which rotates within a ring or internal gear element (that is, the ring or internal gear element is an element having gear-like "teeth" directed inwardly on the inside of a ring), or the assembly of both the gear-type member and the ring or internal gear element taken together. The rotating gear-type member generally has one fewer teeth than the relatively stationary internal or ring gear. In either case, it is understood that the assembly is designed so that the rotating gear-type member is confined to a rotation path such that its center must revolve around the center of the internal or ring gear, even without a rigid connection between the centers. This is normally accomplished by dimensioning both members so that when one of the teeth of the rotating member is at the full depth of a recess in the ring member, there are two teeth on its opposite side that are in contact with teeth on the ring member, preventing it from disengaging.

In the present description and claims, "gerotor" is used in the first sense—that is, to refer to the gear-type member which rotates within the relatively stationary ring or internal gear element, always in contact with the ring gear element on generally opposite sides so that its motion can only result in the revolution of its center around the center of the ring gear element. The relatively stationary ring or internal gear element is the "gerotor guide." "Gerotor bearing" in the present specification means a gerotor having a substantially planar surface which can act as a load-bearing surface on a "gerotor guide bearing" or forming a bearing interface with a substantially planar surface such as a countertop or a cabinet floor. A "bearing interface" herein is created when one substantially planar surface rests on another, facilitating turning while supporting a load. Possibly the bearing surfaces will have a low coefficient of friction, but the selection of materials for the bearing surfaces offers a wide range of discretion, since the load is normally distributed over a large interface area. The "gerotor guide bearing" is a substantially planar surface built into a gerotor guide. The gerotor guide bearing may be either within a guide profile, and therefore a bearing surface on which the gerotor resides and is turned, or it may be on the guide's upper surface. The terms "gerotor guide circle" and "gerotor circle" refer to the large and small circle of the 4:3 hypocycloid function which determine the kinematics of the relationship between the gerotor guide and the gerotor of the present invention. They are not tangible parts, but are demonstrable from the tangible parts. As used herein, "Reuleaux triangle" is a geometric figure derived from an equilateral triangle by drawing arcs from each apex to the adjacent apex, having radii equal to the sides of the equilateral triangle. It is one of a family of curves known as curves of constant width, of which the circle is perhaps the most common. As used herein, "Reuleaux triangle" is intended to include slight modifications, such as an "expanded Reuleaux triangle" in which the outer edge is broadened so that its perimeter is substantially uniformly larger than the underlying Reuleaux triangle, and so the resulting figure (or turntable) continues to have a substantially constant width. The expanded Reuleaux triangle is thus a functional equivalent of an unexpanded one, in that the hypocycloid dimensions and ratios are based on the underlying unexpanded Reuleaux triangle in both cases. "Countertop material" is any material used for a kitchen or other countertop. Examples are filled acrylics and filled unsaturated polyester polymers; both thermoplastic and thermoset materials, as well as natural stones, are intended to be included.

DETAILED DESCRIPTION OF THE INVENTION

Figure 1:
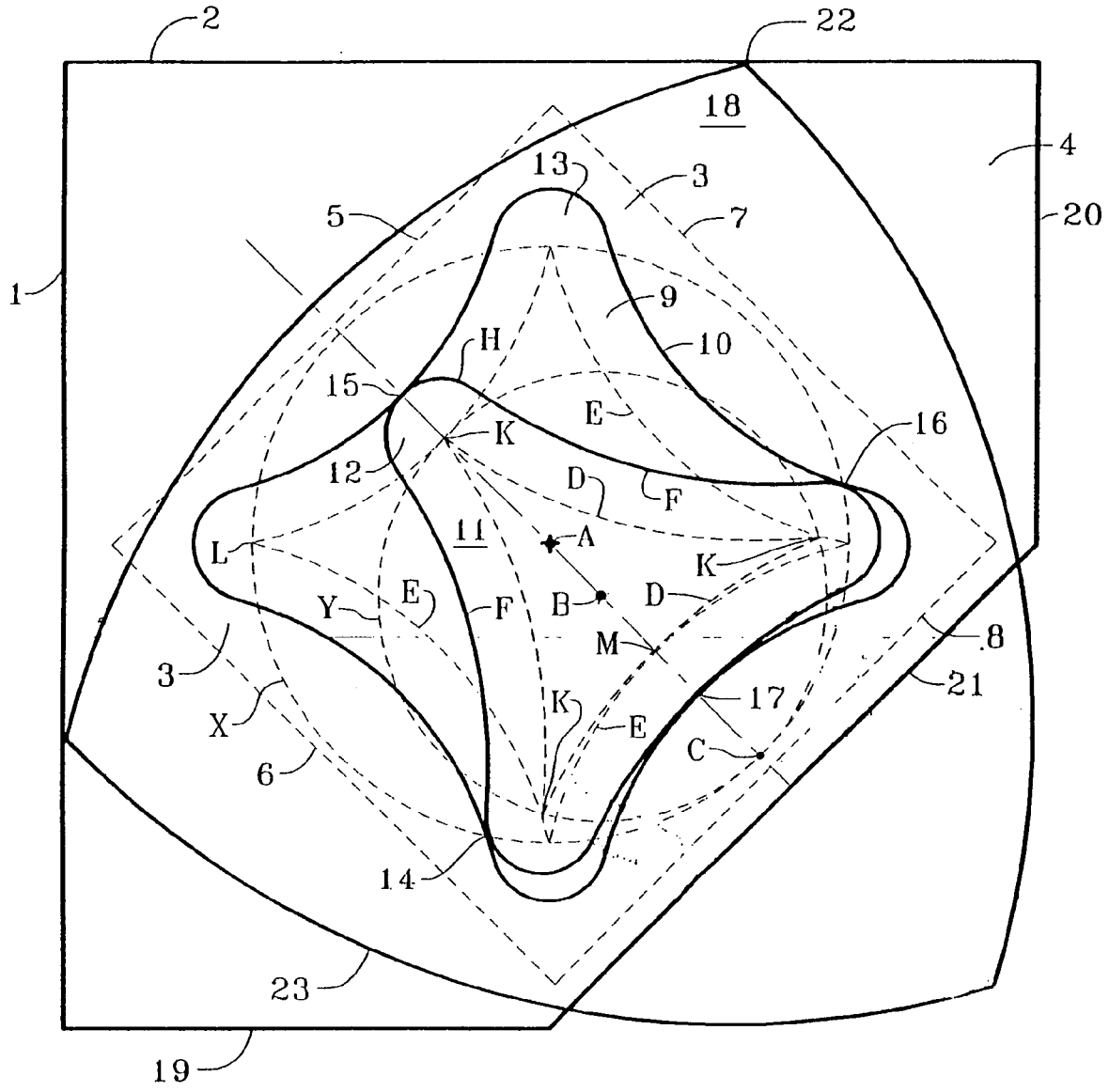
FIG. 1 is a diagrammatic depiction of the three major elements of the invention—the gerotor, the gerotor guide, and the Reauleaux triangle shaped turntable, on the floor of an idealized corner cabinet. The drawing shows the geometric and kinematic relationships of the major parts. The turntable is in the "projecting" position.

Referring to FIG. 1, an outline of a corner comprises walls 1 and 2. A gerotor guide 3 is placed on surface 4 of the corner. Surface 4 together with walls 1 and 2 could be a kitchen countertop, the floor or a shelf of a corner cabinet, or any other corner environment. Gerotor guide 3 may be a square, substantially flat element having a back 5, sides 6 and 7, a front 8, and center A. The principle feature of gerotor guide 3 is as a housing accommodating hollowed-out area 9. Hollowed-out area 9 is shaped to have a profile 10 preferably substantially as shown, which will be explained further below. Hollowed-out area 9 may be to a partial depth in gerotor guide 3 or entirely removed. If area 9 is hollowed out to a depth which leaves a surface in gerotor guide 3, the surface may be substantially planar and possibly low friction. If area 9 is entirely removed from gerotor guide 3, the gerotor guide 3 may be placed on a surface which is substantially planar and possibly having a low coefficient of friction.

Within the hollowed-out area 9 is placed gerotor 11, having the shape substantially as shown and a center B. Gerotor 11 has three lobes 12, while gerotor guide 3 has four corner recesses 13 which form part of profile 10. The lobes 12 are designed and dimensioned to fit into the recesses 13 as the gerotor 11 is turned (see FIG. 2). Note that, when the gerotor 11 is in the position shown in FIG. 1, it contacts profile 10 at four points—contact points 14, 15, 16, and 17. Because of the contours of profile 10 and gerotor 11, gerotor 11 cannot be moved in any direction from the position shown in FIG. 1 except one which will cause center B of the gerotor 11 to begin revolving at a constant distance around center A of the gerotor guide 3. This is so because the gerotor 11 and gerotor guide 3 are based on a hypocycloid function having particular characteristics. It is desirable because gerotor 11 is fixed to a turntable 18 in the shape of a Reuleaux triangle, and the purpose of the invention is to facilitate the rotation of the turntable 18 within a square area outlined by walls 1 and 2 and partially by front edges 19 and 20. Front edges 19 and 20 may be considered merely to define an area of interest on a countertop, for example, or, together with the 45° face 21, the outline of a corner cabinet.

The shapes of profile 10 and gerotor 11 may be understood with reference to circles X and Y. Circles X and Y are not actual parts of the apparatus, but illustrate the kinematic principles on which the apparatus is based. Circle X has a center A, which is the same center A of the gerotor guide 3 (and also the center of the square defined by walls 1 and 2 and front edges 19 and 20), and circle Y has center B, the same center as center B of gerotor 11. Circle X is sometimes called herein the "gerotor guide circle" and circle Y is sometimes the "gerotor circle." The diameters of circles X and Y are in a ratio of 4:3, and in FIG. 1 they contact at point C. The kinematics of the rotation of gerotor 11 within gerotor guide 3 are governed by a hypocycloid function wherein the smaller circle Y, which may be imagined as points on the gerotor 11, rotates within larger circle X, representing points on the gerotor guide 3. The diameter of circle X is 0.6184 of the width of turntable 18, i.e. the radius of an arc drawn from an apex 22 of turntable 18 to an opposite side 23 of turntable 18, as is discussed in U.S. Pat. Nos. 5,152,592 and 6,568,772, incorporated by reference. Dotted lines E represent the path followed by points K on smaller circle Y as smaller circle Y rotates within larger circle X, contacting it at all times as is required for a hypocycloid function. There are three points K on circle Y, 120° apart. Points K contact the large circle X at four points L 90° apart on circle X as circle Y rotates within circle X. Dotted lines D represent the path followed by a point on a circle (not shown) having a radius ⅔ that of circle Y rolling on the inside of circle Y also in hypocycloid fashion. They may be generated by the parametric equations $x=r/3 \cos \theta+2r/3 \cos \theta/2$ and $y=r/3 \sin \theta-2r/3 \sin \theta/2$, where r is the radius of the small circle. Point M is the same distance from point B as the distance point B is from point A, namely ⅓ of the radius of small circle Y and ¼ of the radius of large circle X. Except when the gerotor 11 is in the position shown in FIG. 2, at least one of the dotted lines D will be in contact with a dotted line E (for example, at point M) as the gerotor 11 is rotated. However, as may be seen, I do not use the shapes of lines D and E themselves to guide the rotation of the gerotor and the turntable, but rather I utilize an "expanded" shape for the gerotor 11 and gerotor guide 3.

Gerotor 11 is defined by contour lines F and lobe profiles H. Contour lines F are separated from dotted lines D along their lengths, in this case by a dimension equal to the distance between point M and point 17. Lobe profile H is an arc having a radius also equal to the distance between point M point 17, and an origin at a point K. The expanded profile 10 of gerotor guide 3 includes recesses 13 connected by concave curves which are a constant distance from dotted lines E, also by a dimension equal to the distance between points M and 17, and recesses 13 are arcs having a radius substantially equal to the radius of lobes 12 on gerotor 11 (and therefore substantially equal to the distance between point M and point 17) and an origin at point L. There are four points L on circle X, ninety degrees apart. As indicated above, in this example of my invention, the gerotor 11 and gerotor guide 3 are expanded beyond the shapes of dotted lines D and E by a dimension equal to the distance between points M and 17, which in this case is about one third the radius of small circle Y. As will be discussed elsewhere herein, my invention includes an expansion factor g which may vary between 0.125 and 0.375 (or more) times the radius of the large circle X. That is, the perimeters of the geometric figures described by dotted lines D and E are expanded uniformly by a dimension selected between 0.1R and 0.5R (or more) where R is the radius of the large circle X.

It should be noted that, in this configuration, the turntable 18 projects through the 45° cabinet face 21. Also note that apex 22 contacts wall 2. As the turntable 18 is moved manually, apex 22 will move in a straight line along wall 2 (its counterpart on wall 1 will also move in a straight line) almost to the corner. Persons skilled in the art may recognize that this diagrammatic depiction idealizes the configuration, and in practice there may be a small distance between wall 2 and apex 22 to avoid friction between turntable 18 and the walls, and to allow for a possible slight misplacement of gerotor guide 3 or a corner slightly off from 90□. Indeed, the turntable need not be used in a corner at all, but it will still describe a square area.

Figure 2:
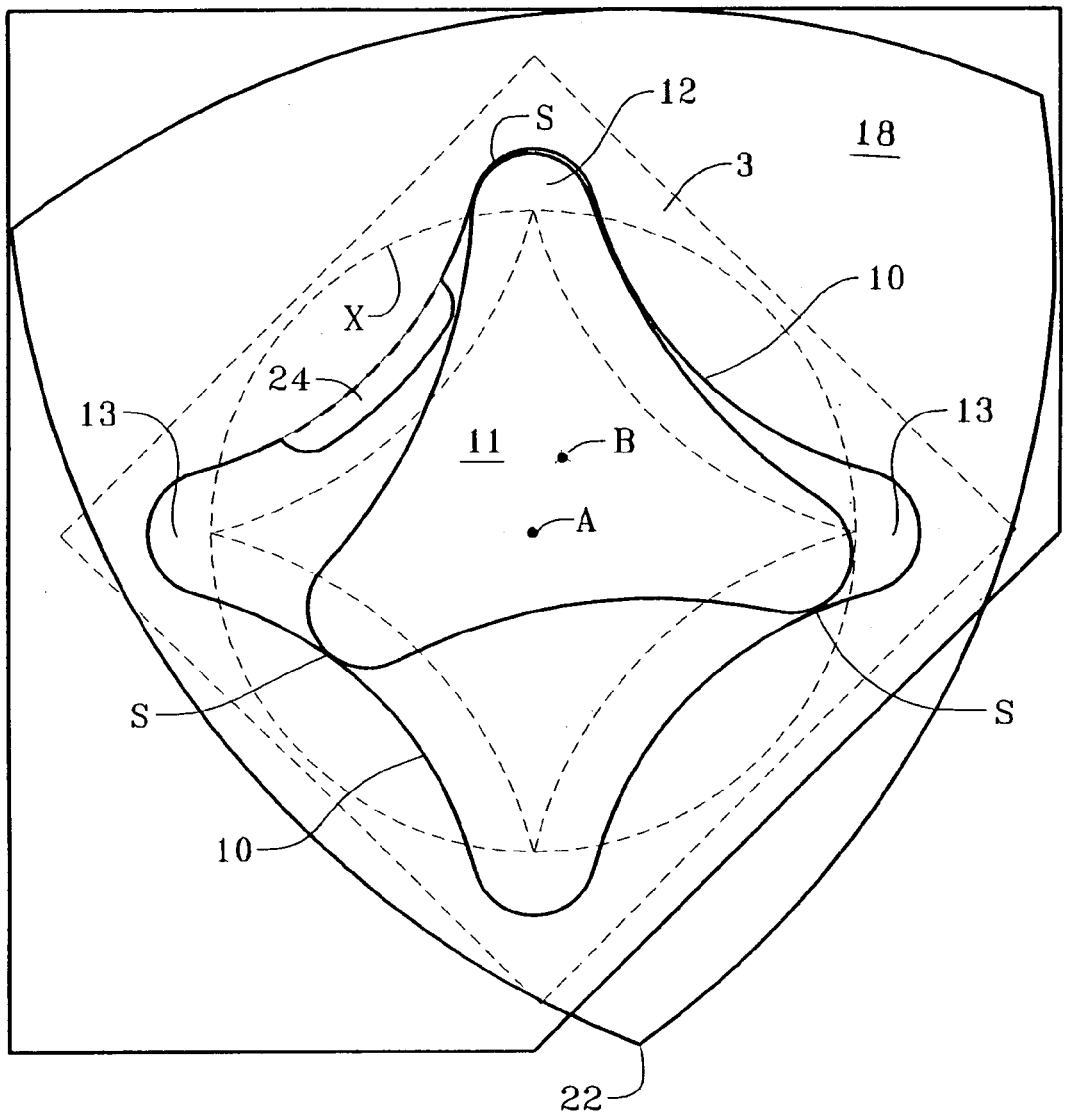
FIG. 2 shows the relationship of the major elements after the turntable has been turned a small angular distance from the position of FIG. 1.

Referring now to FIG. 2, gerotor 11 is shown in a position different from that of FIG. 1. Unlike FIG. 1, gerotor 11 contacts profile 10 at three points S, and one of the lobes 12 of gerotor 11 is entirely within one of the recesses 13 of gerotor guide 3. It will be observed, however, that except for the position of FIG. 2, the gerotor 11 will always be in contact with profile 10 at four points as described with reference to FIG. 1, which assures that the gerotor 11 cannot "float" outside of its prescribed path and will not become bound, anywhere while its center B revolves around center A of the gerotor guide 3. As described in my U.S. Pat. No.

5,152,592, the distance between A and B will remain at 0.0773 of the width of the (Reuleaux triangle) turntable 18, or one-eighth of the diameter of the large circle X.

In FIG. 2 also is a flange 24 the purpose of which is to prevent gerotor 11 from any significant upward movement if an apex 22 of the Reuleaux triangle shaped turntable is subject to a downward force, when it is projecting or approaching the projecting position from a cabinet as in FIG. 1. It is preferred that, if the gerotor guide 3 is placed on the floor of a cabinet or in a shelf of a cabinet, so that the apexes of the turntable will project from the cabinet (see the 45° cabinet face 21 outlined in FIG. 1), the gerotor guide 3 will be a part of, or anchored to, the cabinet floor or a shelf therein so that it will not be tipped by a downward force on a projecting apex 22. When gerotor guide 3 is anchored to the cabinet floor, flange 24 will prevent the turntable from tipping if there is a downward force on projecting apex 22. If gerotor guide 3 is anchored to a shelf, the shelf is preferably one which cannot be lifted in the back without removing a bracket on the back wall. To permit the gerotor 11 to pass underneath the flange 24, the gerotor 11 may be made of a thickness less than the height of profile 10, or otherwise fabricated to permit at least the outer edge of gerotor 11 to pass beneath flange 24. See FIGS. 4*a*–4*e*.

Figure 3:
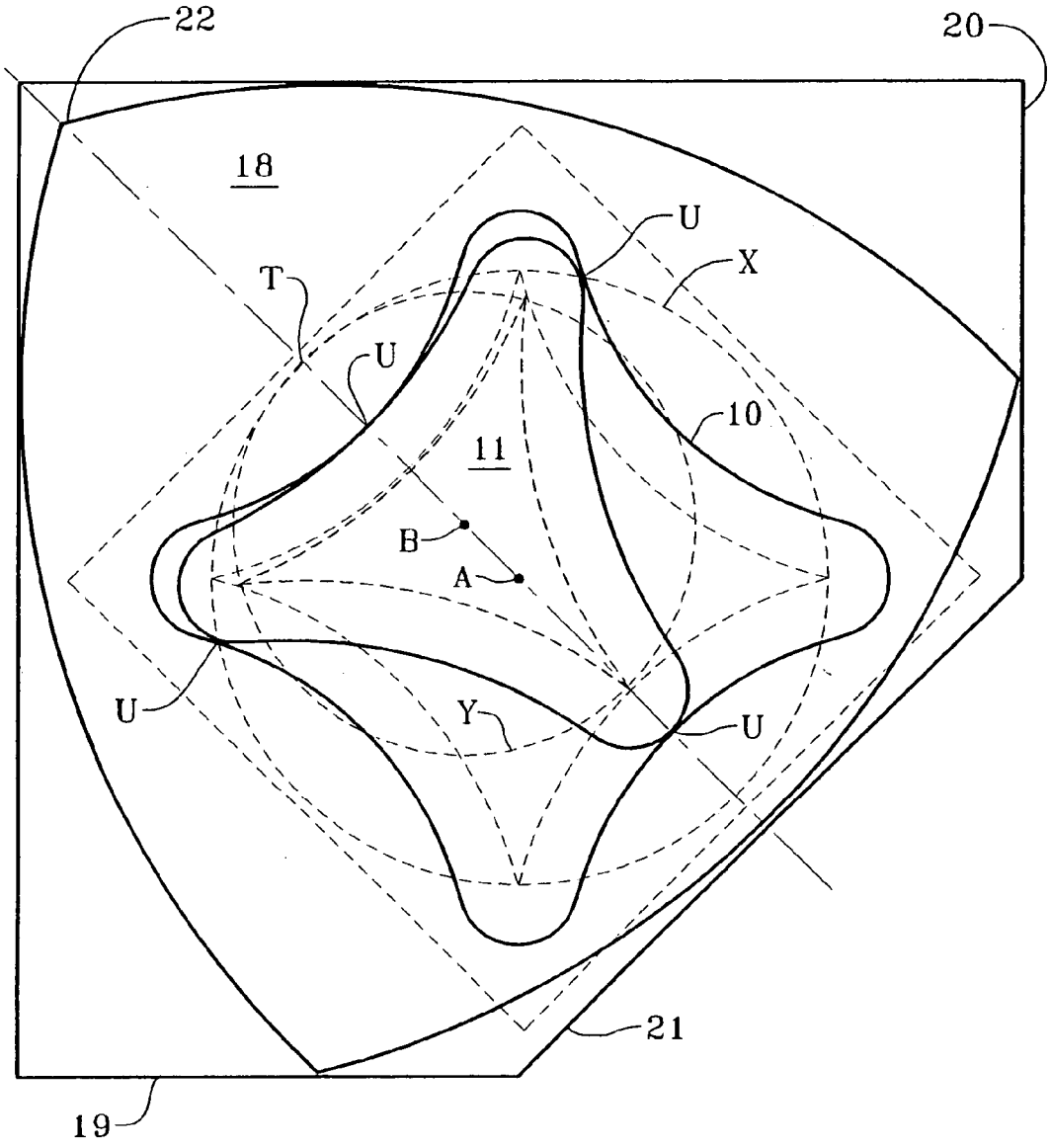
In FIG. 3, the turntable has been turned so that it is in the recessed or "parked" position, projecting into the back corner of the area in which it resides, which is again the idealized outline of the floor of a corner cabinet.

While FIG. 2 shows the turntable 18 in an intermediate position between recessed and projecting, FIG. 3 shows it in the recessed or "parked" position with apex 22 180° from cabinet face 21. If the apparatus is in a cabinet, a door (not shown) could cover its 45□ face 21. Here, the imaginary hypocycloid circle Y (the "gerotor circle") has been rotated so its center B is 180□ around the center point A of circle X (the "gerotor guide circle"), and it now contacts circle X at point T. Continuing the rotation of turntable 18 will cause the center B of circle Y to revolve around center A of circle X at a constant distance ⅛ of the diameter of circle X and 0.0773 times the width of turntable 18. Gerotor 11 is contained within profile 10 at four points U. If the apparatus is on a countertop or other larger surface, edges 19 and 20 of the square area and 45□ face 21 will not be tangible elements—that is, the turntable 18 can simply be rotated on the larger surface, alternately being recessed and projecting.

Figure 4A:
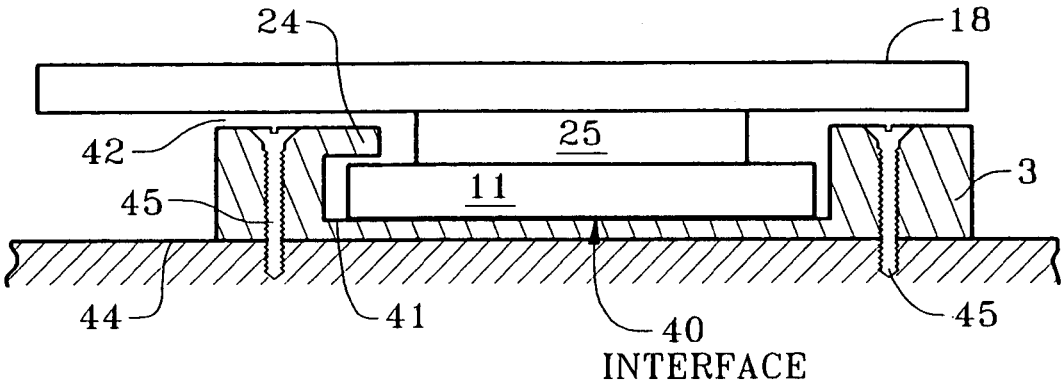
FIG. 4*a* is a side sectional view of the invention, showing the gerotor positioned for turning on a gerotor guide bearing.

In FIG. 4*a*, gerotor 11 is shown attached to turntable 18 by spacer 25. Gerotor 11 has a substantially planar gerotor bearing on its underside, forming a bearing interface at 40 with a substantially planar gerotor guide bearing 41. Here, the gerotor guide bearing 3 is anchored to a cabinet floor 44 by screws 45. Gerotor 11 passes under flange 24 (see FIG. 2); when gerotor 11 is in the projecting position of FIG. 1, the turntable 18 cannot be tipped by a downward force on the projecting apex.

A "substantially planar" surface is not a single point as may describe the contact site of a ball bearing or ball caster, or a line as may describe the contact site of a roller bearing. Rather, a substantially planar surface as contemplated herein assumes the ordinary meaning of a planar area. Typically I will use the entire area available such as the underside of gerotor 11 or the upper surface of gerotor guide 3, but as little as 10% of the available area may be used, particularly if one chooses a low-friction material. For example, special low-friction surfaces may comprise as little as 10% of the area of the underside of gerotor 11; they should be substantially symmetrically deployed.

Figure 4B:
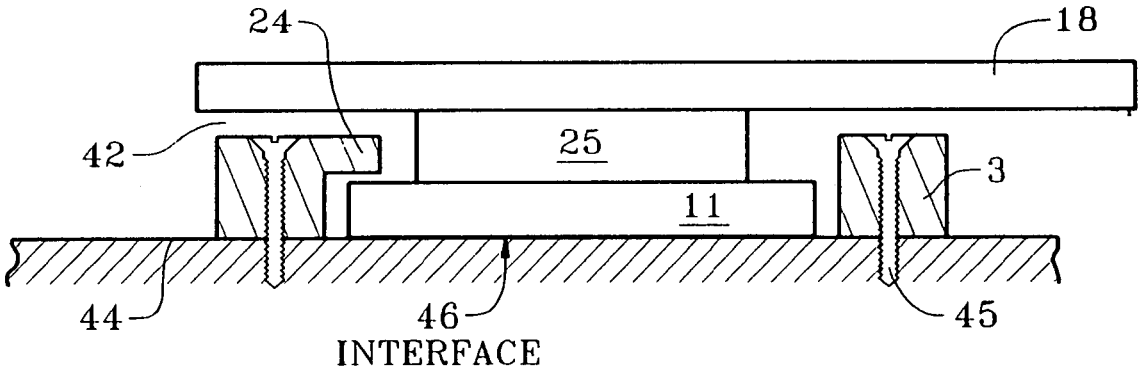
FIG. 4*b* shows a variation in which there is no gerotor guide bearing—rather, the gerotor guide turns on, and forms a bearing interface with, the underlying surface.

Another configuration, in FIG. 4*b*, shows the gerotor bearing surface interfacing at 46 with a cabinet floor 44. The gerotor guide bearing surface 41 of FIG. 4*a* has been eliminated, and the loadbearing occurs at the interface 46 of the gerotor guide bearing and the cabinet floor 44. Again, there is a space 42 between turntable 18 and gerotor guide 3. Gerotor guide 3 may be built into the cabinet floor 44. Persons skilled in the art will recognize that a solid surface countertop may serve the same as a cabinet floor.

Figure 4C:
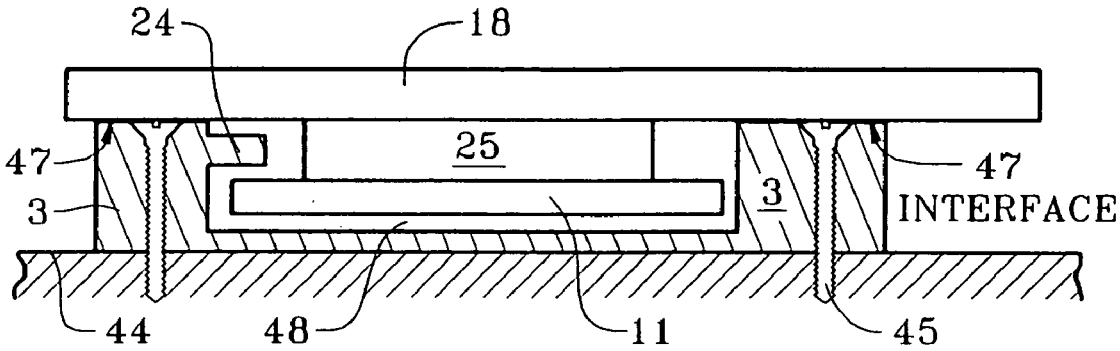
FIG. 4*c* shows a variation wherein the bearing surfaces are at the interface of the turntable and the gerotor guide.

In FIG. 4*c*, the substantially planar bearing interface is between the underside of turntable 18 and the upper surface of gerotor guide 3, specifically at interface 47. There is a space 48 between gerotor 11 and gerotor guide 3 so that no loadbearing takes place on the gerotor 3 itself. The gerotor guide 3 is fixed to a cabinet floor 44 by screws 45.

Figure 4D:
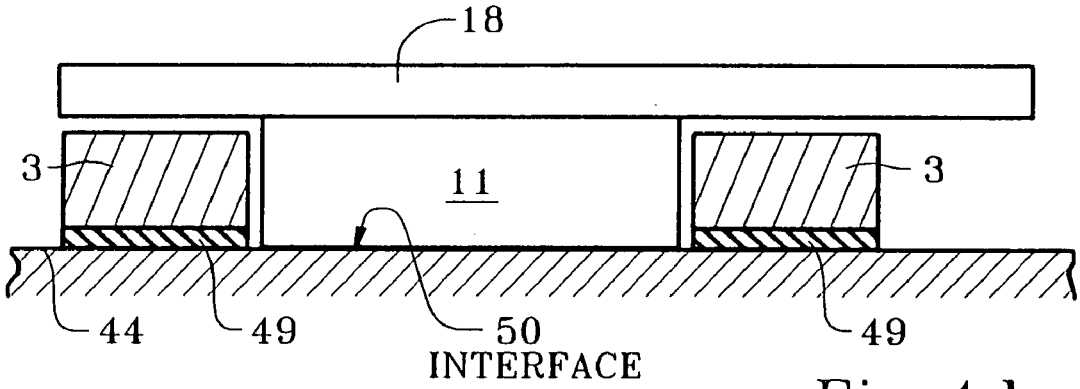
FIG. 4*d* is a variation wherein the gerotor bearing rests on a countertop; this also differs from the other sectional views in that there is no antitipping flange.

FIG. 4*d* is similar to FIG. 4*b* in that the gerotor 11 rests and turns on underlying surface 44 but in this case gerotor guide 3 is held in place by a slip-resistant sheet 49 instead of the screws 45 of FIG. 4*b*. Slip-resistant sheet 49 may be any common household slip-resistant sheet, squares, mats, pads, or "feet" designed to retain a utensil or other object in place by temporarily adhering to the underlying surface. It may be glued or otherwise fastened to the underside of gerotor guide 3, or loose; in either case, the turntable apparatus may be easily moved to clean the area or for any other purpose. It should be noted that this version of my invention has no flange 24, as there is little danger of damage or spillage if turntable 18 is tipped when the apparatus is placed on a larger surface not having a 45° face—that is, for example, in the back or inside corner of a kitchen countertop, which would provide an excellent substantially planar bearing surface on which the complementary substantially planar bearing surface under gerotor 11 may rest and turn, at interface 50. Flange 24 may be eliminated for any environment where tipping of turntable 18 is not anticipated to be a problem.

Figure 4E:
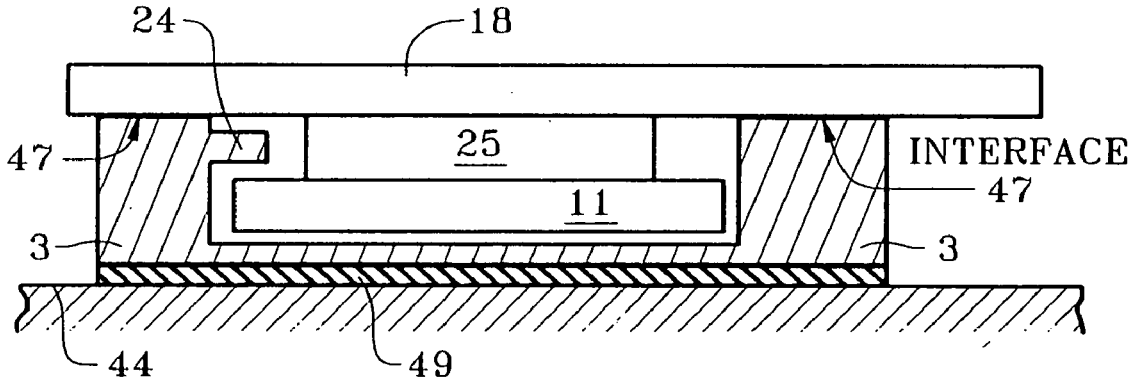
In FIG. 4*e*, the entire gerotor guide rests on a slip-resistant sheet, while the bearing interface is between the turntable and the gerotor guide.

FIG. 4*e* shows a slightly different use of a slip-resistant sheet 49, which extends over the entire underside of gerotor guide 3. Again, it may be fixed to the underside of gerotor guide 3, or simply loose. This version is shown with a flange 24 although it may not be considered necessary if the apparatus resides on a countertop. Load bearing between the turntable 18 and gerotor guide 3 takes place at interface 47 in this variation.

Figure 5:
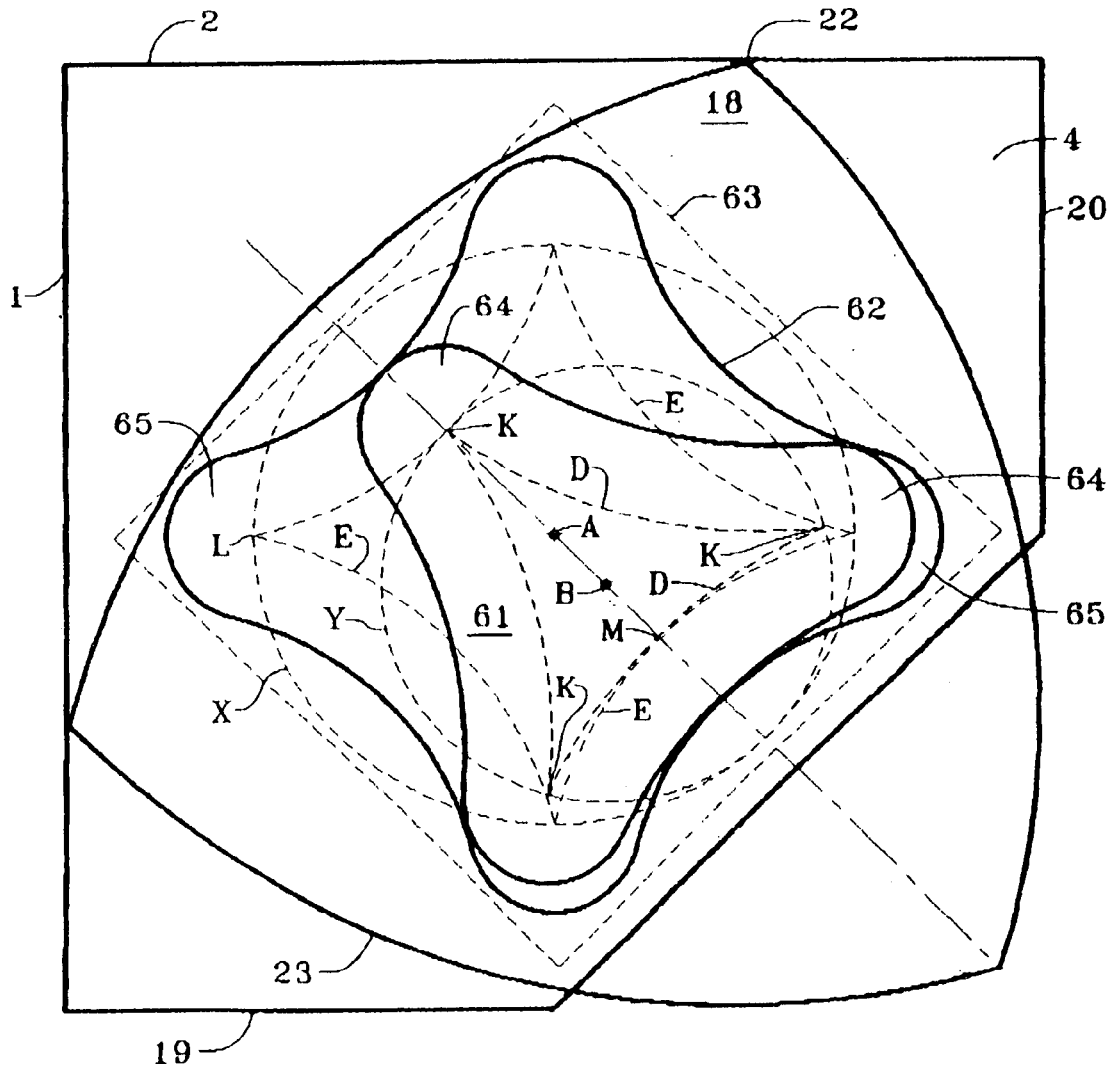
FIG. 5 shows a gerotor and a gerotor guide, again more or less diagrammatically, expanded beyond those of FIGS. 1, 2, and 3.

In FIG. 5, the profile of gerotor 61 has been expanded beyond that of the FIG. 1 version, and the profile 62 of gerotor guide 63 has also been expanded by the same dimension. While the profiles in FIG. 1 were expanded from the shapes of dotted lines D and E by a dimension about 0.25 of the radius of circle X, here the profiles are expanded an additional 0.125R, to about 0.375 times the radius of circle X. Lobes 64 of gerotor 61 fit readily into recesses 65 of gerotor guide 63. Gerotor 61 turns easily in the profile 62 of gerotor guide 63, causing the turntable 18 to turn within the square area defined by walls 1 and 2 and cabinet sides 19 and 20. FIG. 5 shows the shelf or turntable 18 in the projecting position.

Figure 6:
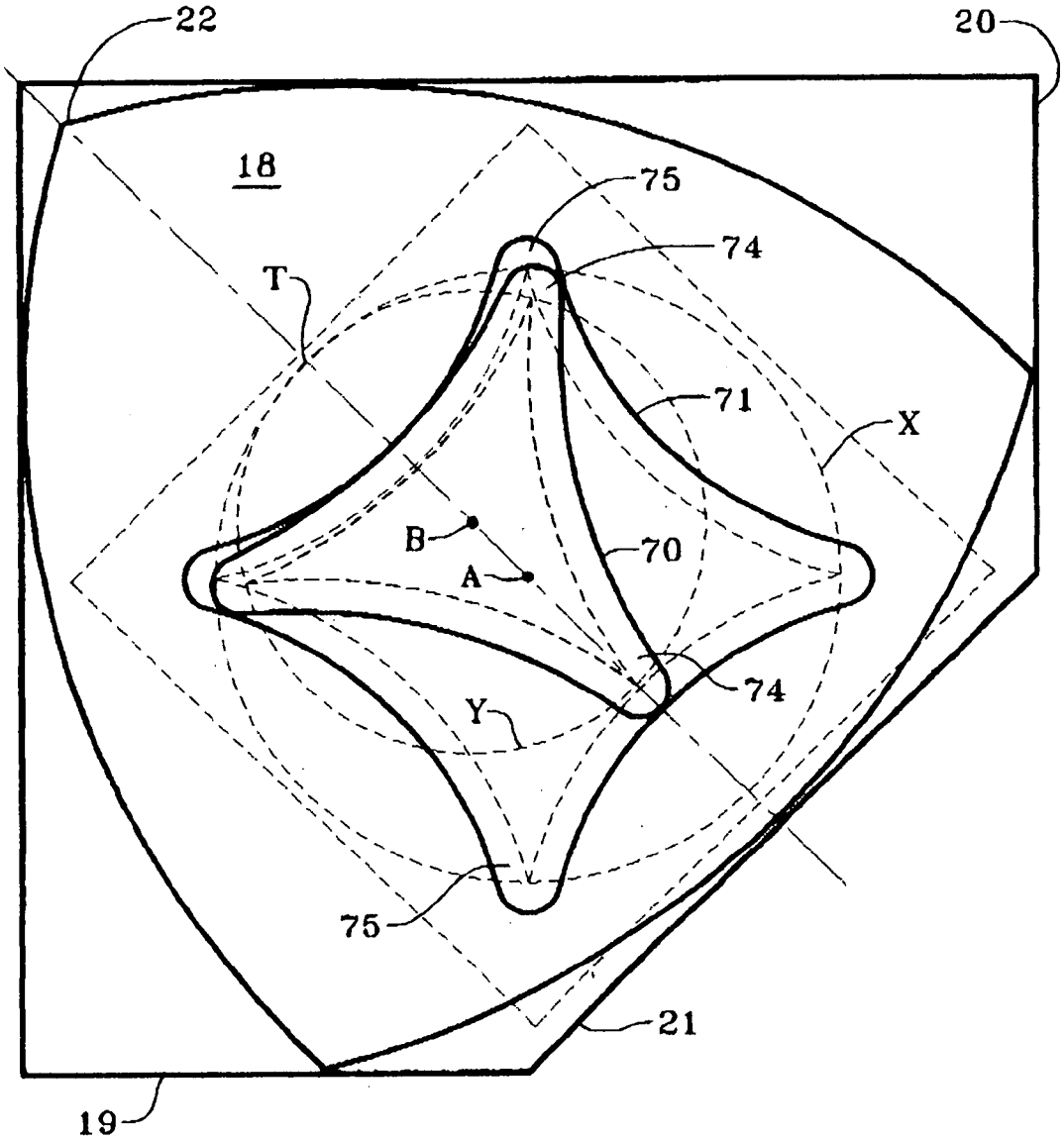
FIG. 6 shows a gerotor and gerotor guide expanded less than those of FIGS. 1, 2, and 3.

FIG. 6 shows the gerotor 70 and gerotor guide 71 expanded to a dimension about 0.1 of the radius of circle Y, making it smaller than the FIG. 1 version. Lobes 74 slide readily into recesses 75. As in FIG. 3, this depicts the recessed position for turntable 18.

In both FIGS. 5 and 6, the gerotors are attached to turntable 18, and manually turning the turntable 18 will cause the gerotor to guide its rotation to remain in the confines of the cabinet walls 1, 2, 19, and 20 or other area in which it resides, such as the back corner of a countertop. The expansions of the shapes formed by dotted lines D and E are to be made uniformly around their perimeters, which means that circular arcs having radii of the expansion factor will be used at points K and L (see FIG. 1) and will be used to form lobes 64 (FIG. 5), 74 (FIG. 6) and recesses 65 (FIG. 5) and 75 (FIG. 6).

Figure 7:
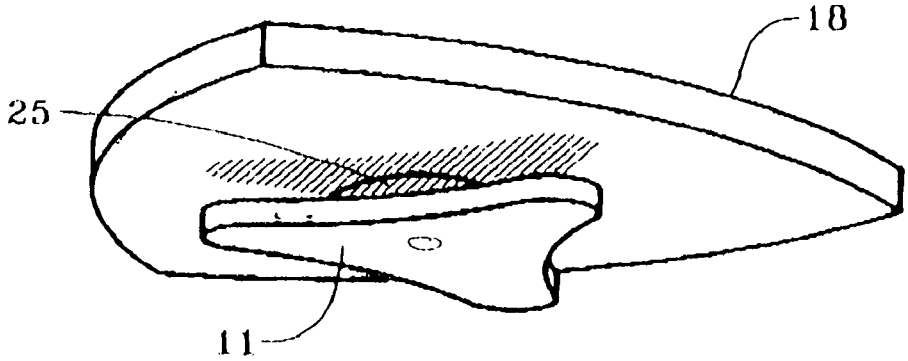
FIG. 7 is an "exploded" or open view of the rotatable and stationary parts of the invention.
Figure 7:
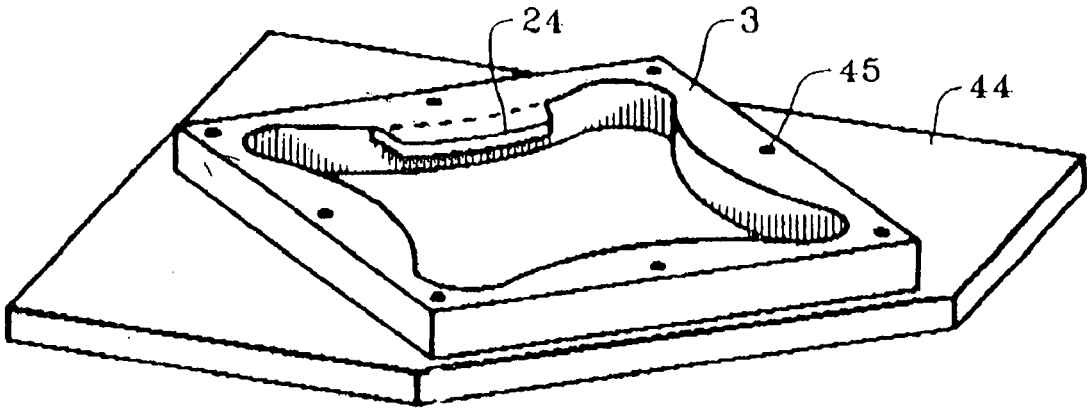

A paradigm of the invention is seen in the open two-part depiction of FIG. 7, showing the underside of turntable 18 and the upper side of gerotor guide 3. Gerotor 11 is attached to turntable 18 through spacer 25. Gerotor guide 3 is attached to cabinet floor 44 by screws 45. Gerotor 11 is easily placed within gerotor guide 3, inserting one of its lobes under flange 24. The assembled unit will then be in the projecting position of FIGS. 1 and 5, and may be turned manually with ease.

Therefore, it seen that my invention includes a gerotor guide comprising a gerotor housing having an expanded internal gerotor guide profile based on the hypocycloid-generated parametric equations $x=0.25R\cdot\cos\theta+0.75R\cdot\cos\theta/3$ and $y=0.25R\cdot\sin\theta-0.75R\cdot\sin\theta/3$ where R is the radius of the large circle in the hypocycloid. My invention further includes turntable apparatus comprising (a) a turntable in the shape of a Reuleaux triangle, the turntable having three apexes, a top and an underside, and having a width W (b) a gerotor fixed to the underside of the turntable, the gerotor having an underside, and (c) a gerotor guide, the gerotor being situated within the gerotor guide so that the center of the gerotor revolves around the center of the gerotor guide as it is moved within the gerotor guide, the centers being a distance 0.0773W apart, whereby the apexes of the turntable describe a substantially square area as they are turned, the turntable apparatus including at least one substantially planar bearing surface for forming a bearing interface. My invention also includes a turntable for manual turning, the turntable being in the shape of a Reuleaux triangle and having a gerotor attached thereto, at lest one of the turntable and the gerotor having a substantially planar bearing surface thereon. and apex 22 to avoid friction between turntable 18 and the walls, and to allow for a possible slight misplacement of gerotor guide 3 or a corner slightly off from 90°. Indeed, the turntable need not be used in a corner at all, but it will still describe a square area.

Referring now to FIG. 2, gerotor 11 is shown in a position different from that of FIG. 1. Unlike FIG. 1, gerotor 11 contacts profile 10 at three points S, and one of the lobes 12 of gerotor 11 is entirely within one of the recesses 13 of gerotor guide 3. It will be observed, however, that except for the position of FIG. 2, the gerotor 11 will always be in contact with profile 10 at four points as described with reference to FIG. 1, which assures that the gerotor 11 cannot "float" outside of its prescribed path and will not become bound, anywhere while its center B revolves around center A of the gerotor guide 3. As described in my U.S. Pat. No. 5,152,592, the distance between A and B will remain at 0.0773 of the width of the (Reuleaux triangle) turntable 18, or one-eighth of the diameter of the large circle X.

In FIG. 2 also is a flange 24 the purpose of which is to prevent gerotor 11 from any significant upward movement if an apex 22 of the Reuleaux triangle shaped turntable is subject to a downward force, when it is projecting or approaching the projecting position from a cabinet as in FIG. 1. It is preferred that, if the gerotor guide 3 is placed on the floor of a cabinet or in a shelf of a cabinet, so that the apexes of the turntable will project from the cabinet (see the 45° cabinet face 21 outlined in FIG. 1), the gerotor guide 3 will be a part of, or anchored to, the cabinet floor or a shelf therein so that it will not be tipped by a downward force on a projecting apex 22. When gerotor guide 3 is anchored to the cabinet floor, flange 24 will prevent the turntable from tipping if there is a downward force on projecting apex 22. If gerotor guide 3 is anchored to a shelf, the shelf is preferably one which cannot be lifted in the back without removing a bracket on the back wall. To permit the gerotor 11 to pass underneath the flange 24, the gerotor 11 may be made of a thickness less than the height of profile 10, or otherwise fabricated to permit at least the outer edge of gerotor 11 to pass beneath flange 24. See FIGS. 4*a*–4*e*.

While FIG. 2 shows the turntable 18 in an intermediate position between recessed and projecting, FIG. 3 shows it in the recessed or "parked" position with apex 22 180° from cabinet face 21. If the apparatus is in a cabinet, a door (not shown) could cover its 45° face 21. Here, the imaginary hypocycloid circle Y (the "gerotor circle") has been rotated so its center B is 180° around the center point A of circle X (the "gerotor guide circle"), and it now contacts circle X at point T. Continuing the rotation of turntable 18 will cause the center B of circle Y to revolve around center A of circle X at a constant distance ⅛ of the diameter of circle X and 0.0773 times the width of turntable 18. Gerotor 11 is contained within profile 10 at four points U. If the apparatus is on a countertop or other larger surface, edges 19 and 20 of the square area and 45° face 21 will not be tangible elements—that is, the turntable 18 can simply be rotated on the larger surface, alternately being recessed and projecting.

In FIG. 4*a*, gerotor 11 is shown attached to turntable 18 by spacer 25. Gerotor 11 has a substantially planar gerotor bearing on its underside, forming a bearing interface at 40 with a substantially planar gerotor guide bearing 41. Here, the gerotor guide bearing 3 is anchored to a cabinet floor 44 by screws 45. Gerotor 11 passes under flange 24 (see FIG. 2); when gerotor 11 is in the projecting position of FIG. 1, the turntable 18 cannot be tipped by a downward force on the projecting apex.

A "substantially planar" surface is not a single point as may describe the contact site of a ball bearing or ball caster, or a line as may describe the contact site of a roller bearing. Rather, a substantially planar surface as contemplated herein assumes the ordinary meaning of a planar area. Typically I will use the entire area available such as the underside of gerotor 11 or the upper surface of gerotor guide 3, but as little as 10% of the available area may be used, particularly if one symbol was intended is self-evident from the context of each of the instances, and in any event a degree symbol is clearly supported elsewhere in the specifications.

The invention claimed is:

1. A gerotor guide comprising a gerotor housing having an internal gerotor guide profile expanded by a dimension g from a geometric figure satisfying the hypocycloid parametric equations $x=0.25R\cos\theta+0.75R\cdot\cos\theta/3$ and $y=0.25R\cdot\sin\theta-0.75R\cdot\sin\theta/3$ where θ is the angle of the center of a small circle with respect to the center of a large circle within which said small circle is rotated while remaining in contact with said large circle, g is a number from 0.1R to 0.5R and R is the radius of the large circle in the hypocycloid.

2. A gerotor guide of claim 1 installed in a 90° corner on a substantially horizontal support.

3. A gerotor guide of claim 2 wherein said horizontal support is a countertop.

4. A gerotor guide of claim 2 wherein said horizontal support is in a cabinet.

5. A gerotor guide of claim 1 wherein said housing includes a substantially planar bearing.

6. Turntable apparatus comprising a gerotor guide of claim 1, a gerotor characterized by an external profile for rotation within said gerotor guide profile, and a turntable attached to said gerotor.

7. Turntable apparatus of claim 6 wherein said turntable is in the shape of a Reuleaux triangle having a width W, the external profile of said gerotor has three lobes and three concave edges, and the centers of said gerotor and said gerotor guide are 0.0773W apart.

8. Turntable apparatus comprising (a) a turntable in the shape of a Reuleaux triangle, said turntable having three apexes, a top and an underside, and having a width W (b) a gerotor fixed to the underside of said turntable, said gerotor having an underside, and (c) a gerotor guide, said gerotor being situated within said gerotor guide so that the center of said gerotor revolves around the center of said gerotor guide as it is moved within said gerotor guide, said centers being a distance 0.0773W apart, whereby said apexes of said turntable describe a substantially square area as they are turned, said turntable apparatus including at least one substantially planar bearing surface for forming a bearing interface.

9. Turntable apparatus of claim 8 wherein said at least one substantially planar bearing surface forms a bearing interface between said underside of said gerotor and said gerotor guide.

10. Turntable apparatus of claim 8 wherein said at least one substantially planar bearing surface forms a bearing interface between said underside of said turntable and said gerotor guide.

11. Turntable apparatus of claim 8 wherein said gerotor guide has an internal profile which is an expansion by an expansion factor gR of a profile which satisfies the hypocycloid parametric equations $x=0.25R\cdot\cos\theta+0.75R\cdot\cos\theta/3$ and $y=0.25R\cdot\sin\theta-0.75R\cdot\sin\theta/3$ where R is the radius of the large circle of the hypocycloid and g is a number from 0.1 to 0.5, and wherein R is 0.6184W/2.

12. A turntable for manual turning, said turntable being in the shape of a Reuleaux triangle and having a gerotor attached thereto, said gerotor having three substantially identical lobes, said gerotor having a substantially planar bearing surface on its underside for interfacing with a substantially planar gerotor guide bearing.

13. A turntable of claim 12 made from countertop material.

14. A turntable of claim 12 including a gerotor guide, said gerotor guide including a guide profile determined by expanding the path followed by a point on a circle having a diameter 0.4638 of the width of said Reuleaux triangle as it turns in a hypocycloid relation to a circle having a diameter 0.6184 of the width of said Reuleaux triangle, said circle being centered in said gerotor guide, said gerotor being set in said gerotor guide to guide the rotation of said turntable.

15. Turntable apparatus comprising (a) a turntable of claim 12 including a gerotor guide having an internal guide profile which is expanded uniformly by a dimension g around the periphery of a figure satisfying the parametric hypocycloid equations $x=0.25R\cdot\cos\theta+0.75R\cdot\cos\theta/3$ and $y=0.25R\cdot\sin\theta-0.75R\cdot\sin\theta/3$ where R is the radius of the large circle of the hypocycloid and g is a value from 0.1R to 0.5R, and wherein said gerotor has a perimeter which is expanded uniformly by said dimension g around the periphery of a figure satisfying the parametric hypocycloid equations $x=r/3\cos\theta+2r/3\cos\theta/2$ and $y=r/3\sin\theta-2r/3\sin\theta/2$, where r is 0.75R and θ is the angle of the center of a small circle with respect to the center of a large circle within which said small circle is rotated while remaining in contact with said large circle.

16. Turntable apparatus of claim 15 wherein said gerotor guide has a substantially planar bearing surface on its underside.

17. Turntable apparatus of claim 16 wherein said gerotor and said gerotor guide have interfacing substantially planar bearing surfaces.

* * * * *